US008203518B2

(12) United States Patent
Yasuda et al.

(10) Patent No.: US 8,203,518 B2
(45) Date of Patent: Jun. 19, 2012

(54) DISPLAY DEVICE

(75) Inventors: Kozo Yasuda, Mobara (JP); Katsumi Matsumoto, Mobara (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 785 days.

(21) Appl. No.: 12/392,136

(22) Filed: Feb. 25, 2009

(65) Prior Publication Data

US 2009/0213057 A1 Aug. 27, 2009

(30) Foreign Application Priority Data

Feb. 26, 2008 (JP) ..... 2008-043795

(51) Int. Cl.
*G09G 3/36* (2006.01)

(52) U.S. Cl. ..... 345/98; 345/100

(58) Field of Classification Search ..... 345/98–100; 326/63–81; 327/333
See application file for complete search history.

(56) References Cited

U.S. PATENT DOCUMENTS 6,909,417 B2 * 6/2005 Washio et al. ..... 345/98
7,649,398 B2 * 1/2010 Park et al. ..... 327/333
7,777,549 B2 * 8/2010 Harada ..... 327/333

FOREIGN PATENT DOCUMENTS

JP 2004-242084 8/2004

* cited by examiner

*Primary Examiner* — Kevin M Nguyen
*Assistant Examiner* — Sepideh Ghafari
(74) *Attorney, Agent, or Firm* — Antonelli, Terry, Stout & Kraus, LLP.

(57) ABSTRACT

Provided is a display device including a level shift circuit, which includes a thin film transistor having a polycrystalline semiconductor layer, and which realizes a reliable operation even when a threshold of the thin film transistor varies. The display device includes: a board; and the level shift circuit which includes the thin film transistor having the polycrystalline semiconductor layer, and is formed on the board, in which the level shift circuit includes: a plurality of source-input level shift circuits including a plurality of unit level shift circuits having drain resistors different in value from one another; and a selection circuit, which selects one of outputs from the plurality of unit level shift circuits as an output from a normally operated unit level shift circuit.

5 Claims, 4 Drawing Sheets

DISPLAY DEVICE

CROSS-REFERENCE TO RELATED APPLICATION

The present application claims priority from Japanese application JP 2008-043795 filed on Feb. 26, 2008, the content of which is hereby incorporated by reference into this application.

BACKGROUND OF THE INVENTION

1. Field of the Invention

The present invention relates to a display device, and more particularly, to an active matrix display device in which a drive circuit (peripheral circuit) is also formed on the same substrate on which a display region is formed.

2. Description of the Related Art

Such a type of display device is referred to as a so-called drive circuit integral type display device, and has a structure being effective for downsizing.

Pixels each having a switching element are arranged in matrix on a display region of the display device. In order to write image data into a pixel, the switching element of the pixel is turned on. While the switching element is in an on-state, a signal supplied from the drive circuit is written as the image data into the pixel.

The switching element includes a thin film transistor. The drive circuit includes a large number of thin film transistors. The thin film transistors of the respective pixels and the thin film transistors of the drive circuit are normally formed side by side.

As also described in, for example, JP 2004-242084 A, a drive circuit including a level shift circuit has been known. The level shift circuit eliminates an inconvenience that a voltage level of an input signal from an external device is different from a voltage level of a circuit in the display device.

SUMMARY OF THE INVENTION

In recent years, a thin film transistor including a semiconductor layer formed of a polycrystalline semiconductor layer (for example, poly-Si layer) has been known as the above-mentioned thin film transistor. When the polycrystalline semiconductor layer is used, a thin film transistor having high charge mobility can be realized.

The thin film transistor including the polycrystalline semiconductor layer normally has a high threshold voltage and a high degree of fluctuations therein. Therefore, for example, with regard to even a circuit which has a level shift circuit formed with a thin film transistor including a single-crystalline semiconductor layer and normally operates, when a level shift circuit formed with the thin film transistor including the polycrystalline semiconductor layer is used for the circuit, there occurs an inconvenience that the circuit no longer normally operate.

That is, because of a current flowing through the thin film transistor, in spite of the fact that an input signal is in a low level, an output voltage does not drop to the low level and thus is held to a high level. Conversely, in spite of the fact that the input signal is in the high level, the output voltage does not increase to the high level and thus is held to the low level.

An object of the present invention is to provide a display device including a level shift circuit which is formed with a thin film transistor including a polycrystalline semiconductor layer and which operates with reliability even when a threshold of the thin film transistor varies.

A typical aspect of the invention disclosed in this application is briefly outlined as follows.

(1) The display device according to the present invention is, for example, a display device including:

a board; and a level shift circuit which includes a thin film transistor having a polycrystalline semiconductor layer, and is formed on the board, in which the level shift circuit includes:

a plurality of source-input level shift circuits; and a selection circuit, in which each of the plurality of source-input level shift circuits includes:

a plurality of unit level shift circuits having drain resistors different in value from one another; and a first level shift circuit and a second level shift circuit which are provided so as to correspond to each of the plurality of unit level shift circuits, in which the first level shift circuit includes:

a drain resistor which is equal in value to the drain resistor of corresponding one of the plurality of unit level shift circuits; and a source terminal to which an input signal which is in a high level is input, in which the second level shift circuit includes:

a drain resistor which is equal in value to the drain resistor of the corresponding one of the plurality of unit level shift circuits; and a source terminal to which an input signal which is in a low level is input, and in which the selection circuit selects an output from one of the plurality of unit level shift circuits based on whether an output from the corresponding first level shift circuit and an output from the corresponding second level shift circuit are in the high level or the low level.

(2) The display device according to the present invention is, for example, the display device according to Item (1), in which the drain resistor of the first level shift circuit and the drain resistor of the second level shift circuit may be formed, on the board, adjacently to the drain resistor of one of the plurality of unit level shift circuits, which corresponds to the first level shift circuit and the second level shift circuit.

(3) The display device according to the present invention is, for example, a display device including:

a board; and a level shift circuit which includes a thin film transistor having a polycrystalline semiconductor layer, and is formed on the board, in which the level shift circuit includes:

a plurality of source-input level shift circuits; and a selection circuit, in which each of the plurality of source-input level shift circuits includes:

two unit level shift circuits having drain resistors different in value from each other; and a first level shift circuit provided so as to correspond to one of the two unit level shift circuits, which has the drain resistor with a larger value, in which the first level shift circuit includes:

a drain resistor which is equal in value to the drain resistor of corresponding one of the two unit level shift circuits; and a source terminal to which an input signal which is in a high level is input, and in which the selection circuit selects an output from one of the two unit level shift circuits, which corresponds to a case where an output from the first level shift circuit is in the high level, and selects an output from the other of the two unit level shift circuits, which corresponds to a case where the output from the first level shift circuit is in a low level.

(4) The display device according to the present invention is, for example, a display device including:

a board; and a level shift circuit which includes a thin film transistor having a polycrystalline semiconductor layer, and is formed on the board, in which the level shift circuit includes:

a plurality of source-input level shift circuits; and a selection circuit, in which each of the plurality of source-input level shift circuits includes:

two unit level shift circuits having drain resistors different in value from each other; and a first level shift circuit provided so as to correspond to one of the two unit level shift circuits, which has the drain resistor with a smaller value, in which the first level shift circuit includes:

a drain resistor which is equal in value to the drain resistor of corresponding one of the two unit level shift circuits; and a source terminal to which an input signal which is in a low level is input, and in which the selection circuit selects an output from one of the two unit level shift circuits, which corresponds to a case where an output from the first level shift circuit is in the low level, and selects an output from the other of the two unit level shift circuits, which corresponds to a case where the output from the first level shift circuit is in a high level.

(5) The display device according to the present invention is, for example, the display device according to Item (1), in which each of the plurality of unit level shift circuits may include a transistor turned on and off in response to an input control signal.

Note that the present invention is not limited to the structures described above, and thus various modifications can be made without departing from the technical idea of the present invention.

The display device having any of the structures as described above includes the level shift circuit with the thin film transistor including the polycrystalline semiconductor layer. The level shift circuit can operate with reliability even when a threshold of the thin film transistor varies.

DETAILED DESCRIPTION OF THE INVENTION

Hereinafter, display devices according to embodiments of the present invention are described with reference to the attached drawings.

Embodiment 1

Figure 1:
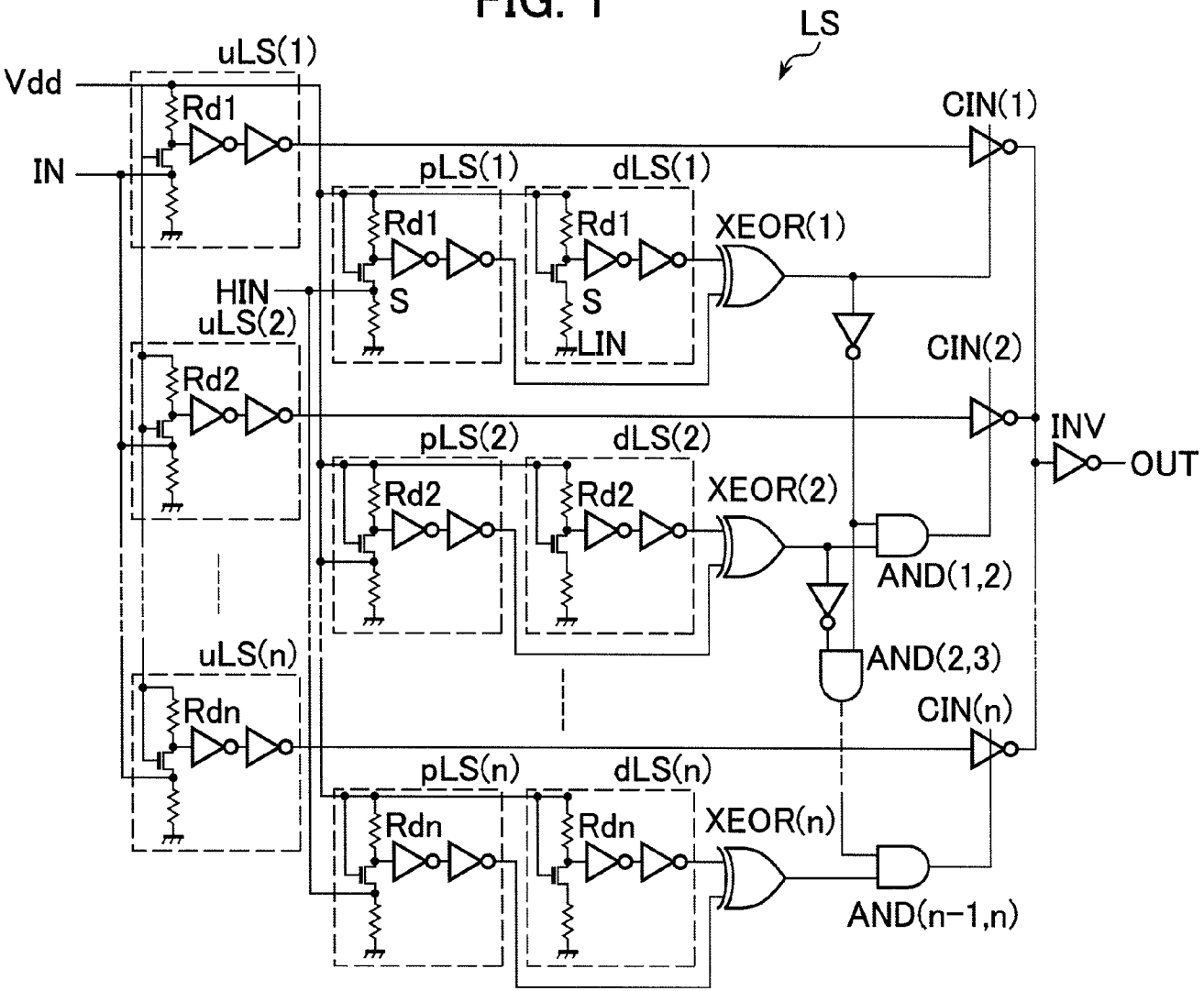
FIG. 1 is a general circuit diagram illustrating a level shift circuit according to an embodiment of the present invention.

FIG. 1 is a circuit diagram illustrating a level shift circuit formed in a display device according to Embodiment 1 of the present invention. The level shift circuit is formed together with other circuits in, for example, a drive circuit.

In the level shift circuit, a plurality of transistors Tr are formed. Each of the transistors Tr is a thin film transistor including a polycrystalline semiconductor layer (for example, poly-Si layer).

A level shift circuit LS illustrated in FIG. 1 includes a plurality of (n) level shift circuits uLS (for convenience of description, referred to as unit level shift circuits) surrounded by broken line frames of FIG. 1 and a circuit for selecting one of outputs from the level shift circuits uLS.

A structure and operation of the unit level shift circuit uLS are described with reference to an example of a circuit illustrated in FIG. 2 before the description of the level shift circuit LS illustrated in FIG. 1.

Figure 2:
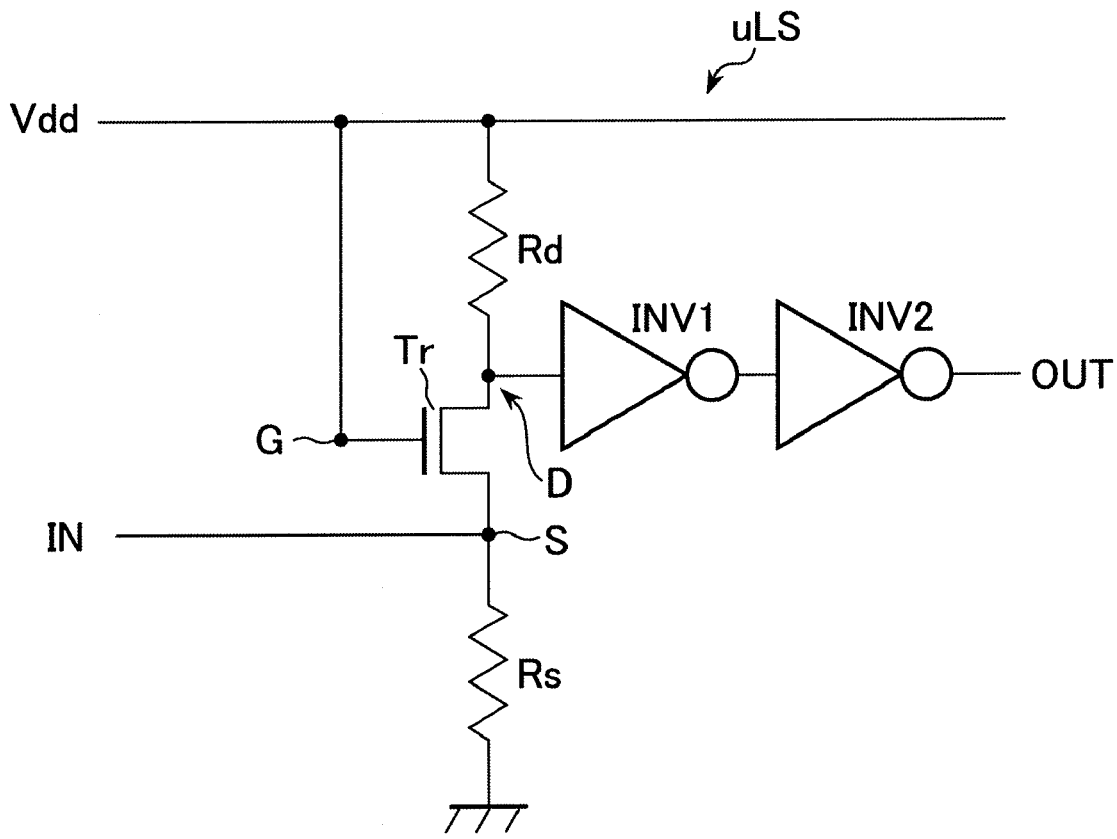
FIG. 2 is a circuit diagram illustrating a unit level shift circuit included in the level shift circuit according to the embodiment of the present invention.

The unit level shift circuit uLS illustrated in FIG. 2 includes an n-type transistor Tr and successively connected inverters INV1 and INV2.

A drain terminal D of the transistor Tr is connected with a drain resistor Rd. The drain resistor Rd is connected with a power supply voltage Vdd.

The power supply voltage Vdd is a voltage equal to or larger than a threshold of the transistor Tr. A gate terminal G of the transistor Tr is connected with the power supply voltage Vdd, and hence the transistor Tr is normally held in an on-state.

A source terminal S of the transistor Tr is connected with an end portion of a source resistor Rs. The other end portion of the source resistor Rs is grounded. An input signal IN is input to the source terminal S thereof. Therefore, the unit level shift circuit uLS illustrated in FIG. 2 is called a source-input level shift circuit.

The drain terminal D of the transistor Tr is connected with the series-connected inverters INV1 and INV2. The inverters INV1 and INV2 power-amplify an output from the transistor Tr.

In the unit level shift circuit uLS having the structure as described above, when the input signal IN is in a low level, a current flows through the transistor Tr, and an output signal OUT becomes a low level because of voltage drop of the drain resistor Rd. When the input signal IN is in a high level, a voltage at the source terminal S of the transistor Tr rises, and hence the current flowing through the transistor Tr reduces and a voltage at the drain terminal D becomes a high level. Then, the series-connected inverters INV1 and INV2 power-amplify the voltage at the drain terminal D and output the output signal OUT. Therefore, even when the high level of the input signal is lower than a threshold voltage of an internal circuit, the unit level shift circuit uLS converts the high level voltage of the input signal into a voltage level higher than the threshold voltage, and hence the internal circuit can be normally driven.

An operating point of the unit level shift circuit uLS can be set based on a value of the drain resistor Rd. When a voltage of the output signal OUT becomes the high level in spite of the fact that the input signal IN is in the low level, the value of the drain resistor Rd is set to be larger, whereby the voltage of the output signal OUT can be changed to the low level. Conversely, when the voltage of the output signal OUT becomes the low level in spite of the fact that the input signal IN is in the high level, the value of the drain resistor Rd is set to be smaller, whereby the voltage of the output signal OUT can be changed to the high level.

Returning to FIG. 1, in the level shift circuit LS illustrated in FIG. 1, n unit level shift circuits uLS are arranged in parallel from an upper part to a lower part in FIG. 1. Each operating point is set based on the value of the drain resistor Rd of each of the unit level shift circuits uLS and changed according to the value thereof.

The respective unit level shift circuits uLS arranged from the upper part to the lower part in FIG. 1 are expressed by reference symbols uLS(1), uLS(2), . . . , uLS(n), respectively. The drain resistors Rd of the respective unit level shift circuits are expressed by reference symbols Rd1, Rd2, . . . , Rdn, respectively.

That is, the unit level shift circuit uLS(1) has the drain resistor Rd1, similarly, the unit level shift circuit uLS(2) has the drain resistor Rd2, . . . , and the unit level shift circuit uLS(n) has the drain resistor Rdn.

Outputs of the unit level shift circuits uLS(1), uLS(2), . . . , uLS(n) are input to clocked inverters CIN(1), CIN(2), . . . , CIN(n), respectively.

A switching circuit including a first level shift circuit pLS (1), a second level shift circuit dLS(1), and a logic circuit XEOR(1) is provided at a subsequent stage of the unit level shift circuit uLS(1).

Similarly, a switching circuit including a first level shift circuit pLS(2), a second level shift circuit dLS(2), and a logic circuit XEOR(2) is provided at a subsequent stage of the unit level shift circuit uLS(2). In the same manner, a switching circuit including a first level shift circuit pLS(n), a second level shift circuit dLS(n), and a logic circuit XEOR(n) is provided at a subsequent stage of the unit level shift circuit uLS(n).

The first level shift circuit pLS(1) has substantially the same structure (including drain resistor Rd1) as the unit level shift circuit uLS(1). Unlike the unit level shift circuit uLS(1), an input signal HIN which is in a high level is input to a source terminal S of the first level shift circuit pLS(1).

Therefore, the first level shift circuit pLS(1) is supposed to output the high level as an output voltage thereof. However, when the value of the drain resistor Rd1 is large and thus an operating point is lower than a threshold relative to the high level, the first level shift circuit pLS(1) outputs a low level as the output voltage.

In other words, when the operating point is higher than the threshold relative to the high level, that is, when the operation upon an input of the high level is good, the first level shift circuit pLS(1) outputs the high level. When the operating point is lower than the threshold relative to the high level, that is, when the operation upon the input of the high level is poor, the first level shift circuit pLS(1) outputs the low level.

The second level shift circuit dLS(1) has substantially the same structure (including drain resistor Rd1) as the unit level shift circuit uLS(1). Unlike the unit level shift circuit uLS(1), an input signal LIN which is in a low level is input to the source terminal S of the second level shift circuit dLS(1), and a resistor corresponding to the source resistor Rs is not connected thereto.

Therefore, the second level shift circuit dLS(1) is supposed to output the low level as an output voltage thereof. However, when the value of the drain resistor Rd1 is small and thus an operating point is higher than a threshold relative to the low level, the second level shift circuit dLS(1) outputs a high level voltage as the output voltage.

In other words, when the operating point is lower than the threshold relative to the low level, that is, when the operation upon an input of the low level is good, the second level shift circuit dLS(1) outputs the low level. When the operating point is higher than the threshold relative to the low level, that is, when the operation upon the input of the low level is poor, the second level shift circuit dLS(1) outputs the high level.

The output from the first level shift circuit pLS(1) and the output from the second level shift circuit dLS(1) are input to the exclusive OR circuit XEOR(1). Only when the first level shift circuit pLS(1) operates well at the high level to output the high level voltage and the second level shift circuit dLS(1) operates well at the low level to output the low level voltage, the exclusive OR circuit XEOR(1) outputs the high level voltage. In contrast to this, when the operation at any one of the high level and the low level is poor, both the first level shift circuit pLS(1) and the second level shift circuit dLS(1) output the high level voltage or the low level voltage. Therefore, the exclusive OR circuit XEOR(1) outputs the low level voltage. Thus, whether the operation of the unit level shift circuit uLS(1) is good or poor can be simply determined.

A switching circuit including the first level shift circuit pLS(2), the second level shift circuit dLS(2), and the exclusive OR circuit XEOR(2), which is located at the subsequent stage of the unit level shift circuit uLS(2), . . . , and a switching circuit including the first level shift circuit pLS(n), the second level shift circuit dLS(n), and the exclusive OR circuit XEOR (n), which is located at the subsequent stage of the unit level shift circuit uLS(n) have the same role.

For example, the unit level shift circuit uLS(1), the first level shift circuit pLS(1), and the second level shift circuit dLS(1) have the drain resistors Rd1 having values equal to one another. The respective drain resistors Rd1 are formed adjacently to one another on a board to thereby make the operating points of the respective level shift circuits equal to one another. Such a structure is similarly applied to other unit level shift circuits uLS and the switching circuits located at the subsequent stage thereof. Therefore, of the respective unit level shift circuits uLS(1), uLS(2), . . . , uLS(n), a unit level shift circuit which correctly operates can be selected.

In the embodiment described with reference to FIG. 1, an inverted output of the exclusive OR circuit XEOR (for example, XEOR(1)) located at an upper part and an output of the exclusive OR circuit XEOR (for example, XEOR(2)) located at a next part are input to an AND circuit AND (for example, AND(1,2)), whereby the unit level shift circuit uLS which correctly operates (for example, uLS(1) or uLS(2)) can be selected. When the value of the drain resistors Rd is reduced from the upper part side to the lower part side, due to the fact that the output at the upper part is inverted, the unit level shift circuit uLS which operates well at the high level for the first time and has the drain resistor Rd is selected.

An output from the exclusive OR circuit XEOR(1) is input to the clocked inverter CIN(1) to which the output of the unit level shift circuit uLS(1) is input. Outputs from the AND circuits AND(1,2), . . . , (n−1,n) are input to the respective clocked inverters CIN(2), . . . , CIN(n) to which the outputs of the unit level shift circuits uLS(2), . . . , uLS(n) are input.

The clocked inverters CIN(1), . . . , CIN(n) operate as inverters when the output of the exclusive OR circuit XEOR (1) and the outputs of the AND circuits AND(1,2), . . . , (n−1,n) are in the high level, and become a high impedance when the outputs thereof are in the low level.

The outputs of the respective clocked inverters CIN(1), . . . , CIN(n) can be output through an inverter INV.

In the level shift circuit LS having the structure as described above, the n unit level shift circuits uLS are set such that the operating points thereof are different from one another. Therefore, even when the operating points are shifted by a variation in threshold voltage or power supply voltage, the unit level shift circuit uLS having a suitable operating region corresponding to the variation can be selected, and an output of the selected unit level shift circuit uLS is used. Therefore, it is possible to obtain the level shift circuit LS which can be operated in accordance with the fluctuations in threshold voltage or power supply voltage.

In FIG. 1, the structure including the n unit level shift circuits uLS is provided. A structure including two or three unit level shift circuits can be provided as a sufficiently practical structure. When the number of unit level shift circuits uLS is three, a circuit having three operating points in cases where a threshold is shifted to an upper side and a lower side relative to a set operating region is to be provided.

Embodiment 2

Figure 3A:
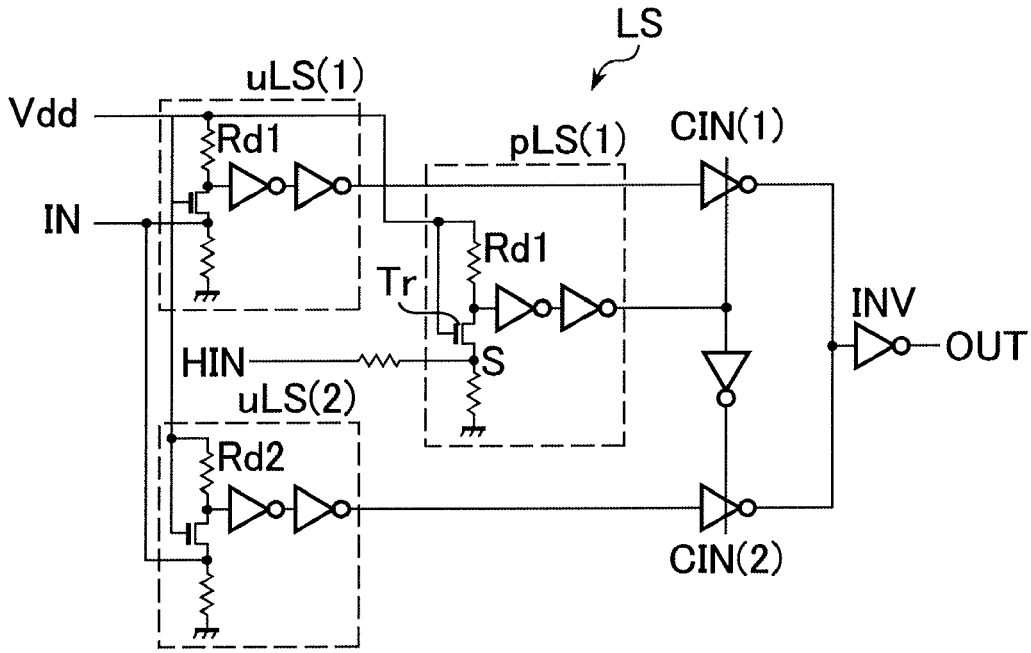
FIGS. 3A and 3B are overall circuit diagrams illustrating level shift circuits according to another embodiment of the present invention.
Figure 3B:
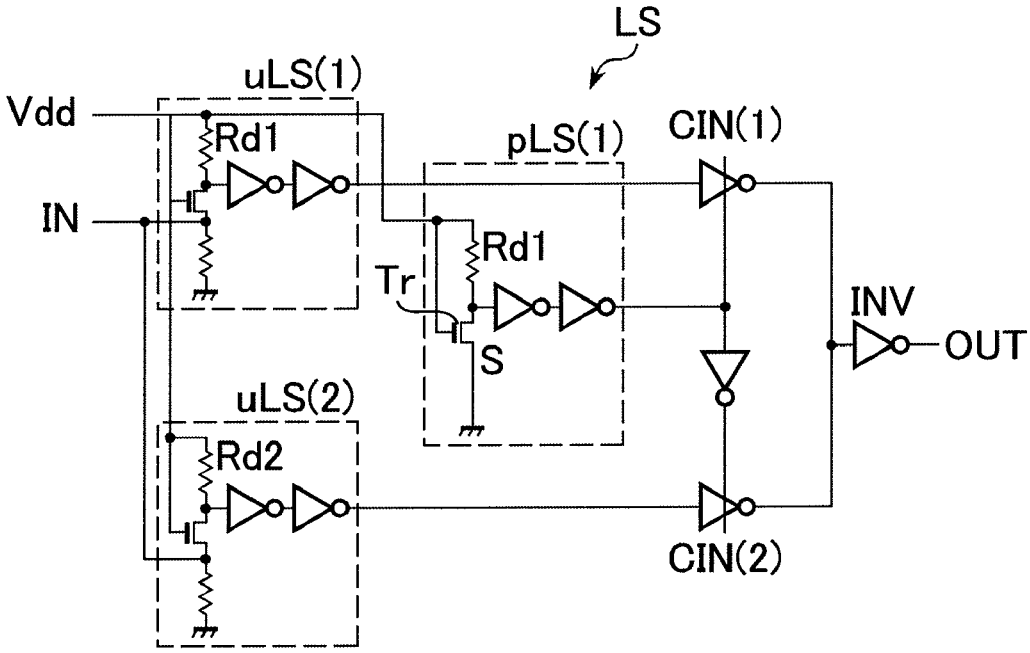

FIGS. 3A and 3B are circuit diagrams illustrating level shift circuits according to another embodiment of the present invention.

Each of the level shift circuits LS illustrated in FIGS. 3A and 3B includes two unit level shift circuits. In this case, a circuit for taking measures in a case where a threshold is shifted to an upper side relative to a set operating region and a circuit for taking measures in a case where the threshold is shifted to a lower side relative thereto can be obtained.

FIG. 3A illustrates the circuit for taking measures in the case where the threshold is shifted to the lower-voltage side.

In FIG. 3A, a resistance value of the drain resistor Rd1 of the unit level shift circuit uLS(1) is set to be large and a resistance value of the drain resistor Rd2 of the unit level shift circuit uLS(2) is set to be small.

The first level shift circuit pLS(1) is provided and has substantially the same structure (including drain resistor Rd1) as the unit level shift circuit uLS(1). Unlike the unit level shift circuit uLS(1), the input signal HIN which is in the high level is input to the source terminal S of the first level shift circuit pLS(1).

When the first level shift circuit pLS(1) operates well upon an input of the high level, the output of the first level shift circuit pLS(1) becomes the high level, and hence the unit level shift circuit uLS(1) is selected by the clocked inverter CIN(1).

When the threshold of the transistor Tr is shifted to the low-voltage side, a current flowing through the transistor Tr rises and the output of the first level shift circuit pLS(1) becomes the low level, and hence the unit level shift circuit uLS(2) is selected by the clocked inverter CIN(2).

The value of the drain resistor Rd2 included in the unit level shift circuit uLS(2) is small and thus the unit level shift circuit uLS(2) has a high operating point. Therefore, even when the threshold of the transistor Tr is shifted to the low-voltage side, the unit level shift circuit uLS(2) outputs the high level upon the input of the high level.

FIG. 3B illustrates the circuit for taking measures in the case where the threshold is shifted to the higher-voltage side.

In FIG. 3B, the members expressed by the same reference symbols as in FIG. 3A have the same functions. Unlike the case of FIG. 3A, the resistance value of the drain resistor Rd1 of the unit level shift circuit uLS(1) is set to be small and the resistance value of the drain resistor Rd2 of the unit level shift circuit uLS(2) is set to be large. The first level shift circuit pLS(1) is provided and the input signal which is in the low level is input to the source terminal S thereof. Note that the resistance value of the drain resistor Rd1 of the first level shift circuit pLS(1) is equal to the resistance value of the drain resistor Rd1 of the unit level shift circuit uLS(1).

When the first level shift circuit pLS(1) operates well upon an input of the low level, the unit level shift circuit uLS(1) is selected. When the threshold is shifted to the higher-voltage side, the unit level shift circuit uLS(2) is selected.

Embodiment 3

Figure 4:
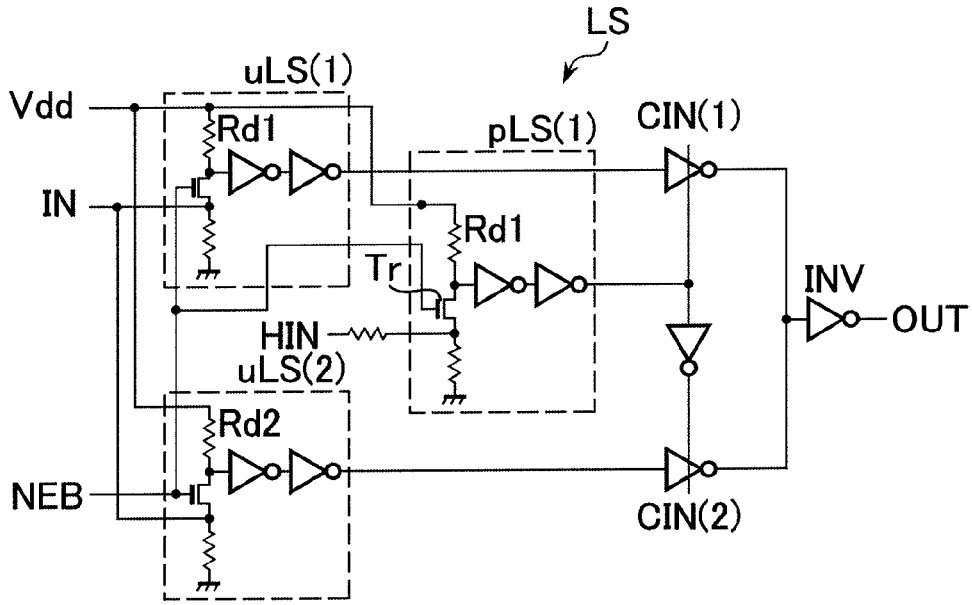
FIG. 4 is an overall circuit diagram illustrating a level shift circuit according to still another embodiment of the present invention.
Figure 5:
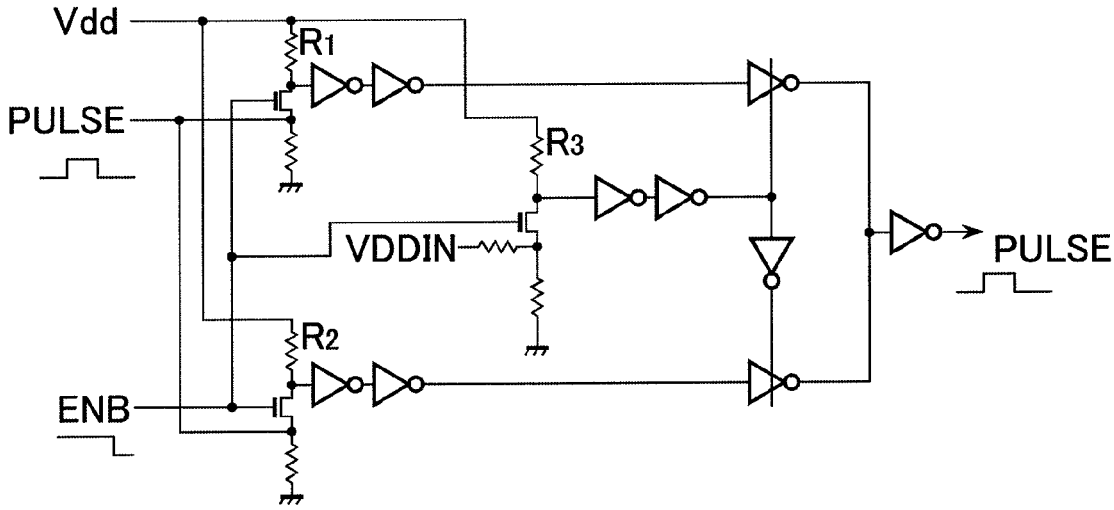
FIG. 5 is an overall circuit diagram illustrating a level shift circuit according to still another embodiment of the present invention.

FIGS. 4 and 5 illustrate a level shift circuit according to another embodiment of the present invention and correspond to, for example, the embodiment described with reference to FIGS. 3A and 3B.

The structure according to this embodiment is different from the structure of FIG. 3A and 3B in that a control signal ENB for turning off each of the transistor Tr of the unit level shift circuit uLS(1) and the transistor Tr of the unit level shift circuit uLS(2) is input thereto.

With such a structure, an increase in power consumption which is caused by currents flowing through the respective drain resistors Rd in a standby mode in which the level shift circuit LS is not used can be suppressed.

Such a structure can be also applied to the structure illustrated in FIG. 1.

Note that the control signal may be generated in the internal circuit or input from the outside.

The respective embodiments described above may be used separately or in combination. This is because the effects of the respective embodiments can be obtained separately or in combination. While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device, comprising:

a board; and a level shift circuit which includes a thin film transistor having a polycrystalline semiconductor layer, and is formed on the board, wherein the level shift circuit includes:

a plurality of source-input level shift circuits; and a selection circuit, wherein each of the plurality of source-input level shift circuits includes:

a plurality of unit level shift circuits having drain resistors different in value from one another; and a first level shift circuit and a second level shift circuit which are provided so as to correspond to each of the plurality of unit level shift circuits, wherein the first level shift circuit includes:

a drain resistor which is equal in value to the drain resistor of corresponding one of the plurality of unit level shift circuits; and a source terminal to which an input signal which is in a high level is input, wherein the second level shift circuit includes:

a drain resistor which is equal in value to the drain resistor of the corresponding one of the plurality of unit level shift circuits; and a source terminal to which an input signal which is in a low level is input, and wherein the selection circuit selects an output from one of the plurality of unit level shift circuits based on whether an output from the corresponding first level shift circuit and an output from the corresponding second level shift circuit are in the high level or the low level.

2. A display device according to claim 1, wherein the drain resistor of the first level shift circuit and the drain resistor of the second level shift circuit are formed, on the board, adjacently to the drain resistor of one of the plurality of unit level shift circuits, which corresponds to the first level shift circuit and the second level shift circuit.

3. A display device, comprising:

a board; and a level shift circuit which includes a thin film transistor having a polycrystalline semiconductor layer, and is formed on the board, wherein the level shift circuit includes:

a plurality of source-input level shift circuits; and a selection circuit, wherein each of the plurality of source-input level shift circuits includes:

two unit level shift circuits having drain resistors different in value from each other; and a first level shift circuit provided so as to correspond to one of the two unit level shift circuits, which has the drain resistor with a larger value, wherein the first level shift circuit includes:

a drain resistor which is equal in value to the drain resistor of corresponding one of the two unit level shift circuits; and a source terminal to which an input signal which is in a high level is input, and wherein the selection circuit selects an output from one of the two unit level shift circuits, which corresponds to a case where an output from the first level shift circuit is in the high level, and selects an output from the other of the two unit level shift circuits, which corresponds to a case where the output from the first level shift circuit is in a low level.

4. A display device, comprising:

a board; and a level shift circuit which includes a thin film transistor having a polycrystalline semiconductor layer, and is formed on the board, wherein the level shift circuit includes:

a plurality of source-input level shift circuits; and a selection circuit, wherein each of the plurality of source-input level shift circuits includes:

two unit level shift circuits having drain resistors different in value from each other; and a first level shift circuit provided so as to correspond to one of the two unit level shift circuits, which has the drain resistor with a smaller value, wherein the first level shift circuit includes:

a drain resistor which is equal in value to the drain resistor of corresponding one of the two unit level shift circuits; and a source terminal to which an input signal which is in a low level is input, and wherein the selection circuit selects an output from one of the two unit level shift circuits, which corresponds to a case where an output from the first level shift circuit is in the low level, and selects an output from the other of the two unit level shift circuits, which corresponds to a case where the output from the first level shift circuit is in a high level.

5. A display device according to claim 1, wherein each of the plurality of unit level shift circuits comprises a transistor turned on and off in response to an input control signal.

* * * * *